US006135188A

United States Patent [19]

Anderson et al.

[11] Patent Number: 6,135,188

[45] **Date of Patent: *Oct. 24, 2000**

[54] TASSEL FOR CONTROL SYSTEM FOR A VERTICAL VANE COVERING FOR ARCHITECTURAL OPENINGS

[75] Inventors: Richard N. Anderson, Whitesville; Eugene W. Thompson, Maceo, both of Ky.

[73] Assignee: Hunter Douglas Inc., Upper Saddle River, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/724,576

[22] Filed: Sep. 30, 1996

[51] Int. Cl.[7] ..... E06B 9/36

[52] U.S. Cl. ..... 160/178.1 V; 160/900

[58] Field of Search ..... 160/178.1 R, 178.1 V, 160/173 V, 320, 344, 345, 168.1 V, 168.1 R; 16/121, 122, 123

[56] References Cited

U.S. PATENT DOCUMENTS

| | | | |
|---|---|---|---|
| D. 231,326 | 4/1974 | Miki . | |
| D. 325,681 | 4/1992 | Gartenmaier . | |
| 1,820,328 | 8/1931 | Schlegel | 16/122 |
| 2,164,206 | 6/1939 | Gits et al. | 16/122 |
| 2,621,723 | 12/1952 | Etten . | |
| 2,660,751 | 12/1953 | Falkenberg | 16/122 |
| 2,759,534 | 8/1956 | Harju . | |
| 2,854,071 | 9/1958 | Toti . | |
| 2,876,834 | 3/1959 | Walker . | |
| 3,334,682 | 8/1967 | Eldredge, Jr. . | |
| 3,486,549 | 12/1969 | Rosenquist . | |
| 3,996,988 | 12/1976 | de Witt . | |
| 4,214,622 | 7/1980 | Debs . | |
| 4,267,875 | 5/1981 | Koks . | |
| 4,293,021 | 10/1981 | Arena . | |
| 4,316,493 | 2/1982 | Arena . | |
| 4,361,179 | 11/1982 | Benthin . | |
| 4,366,852 | 1/1983 | Holzer | 160/320 |
| 4,381,029 | 4/1983 | Ford et al. . | |
| 4,386,644 | 6/1983 | Debs . | |
| 4,425,955 | 1/1984 | Kaucic . | |
| 4,628,981 | 12/1986 | Ciriaci et al. . | |
| 4,648,436 | 3/1987 | Oskam . | |
| 4,724,883 | 2/1988 | Liebowitz . | |
| 4,773,464 | 9/1988 | Kobayashi . | |
| 4,799,527 | 1/1989 | Villoch et al. . | |
| 4,834,163 | 5/1989 | Dickstein . | |
| 4,869,309 | 9/1989 | Evans . | |
| 4,909,298 | 3/1990 | Langhart et al. | 160/178.1 R |
| 5,012,850 | 5/1991 | Schrader . | |
| 5,088,542 | 2/1992 | Biba et al. . | |
| 5,249,617 | 10/1993 | Durig . | |
| 5,289,863 | 3/1994 | Schon . | |
| 5,351,741 | 10/1994 | Swopes . | |
| 5,560,414 | 10/1996 | Judkins et al. | 160/178.1 R |
| 5,562,140 | 10/1996 | Biba | 160/178.1 R |

FOREIGN PATENT DOCUMENTS

| | | |
|---|---|---|
| 120425 | 10/1984 | European Pat. Off. . |
| 159812 | 10/1985 | European Pat. Off. . |
| 0446587 | 9/1991 | European Pat. Off. . |
| 2308280 | 11/1976 | France . |
| 91 05 869 | 8/1991 | Germany . |
| 868961 | 5/1961 | United Kingdom . |
| 1159635 | 7/1969 | United Kingdom . |
| 1470533 | 4/1977 | United Kingdom . |
| 2174441 | 8/1986 | United Kingdom . |
| 2247488 | 3/1992 | United Kingdom . |

*Primary Examiner*—David M. Purol
*Attorney, Agent, or Firm*—Dorsey & Whitney LLP

[57] ABSTRACT

A tassel for use in a control system for a covering for an architectural opening is adapted to be positioned at each end of a control cord which is suspended from an end of the headrail for the covering. The ends of the control cord are spaced a predetermined distance and the tassels are dimensioned in a transverse direction such that they do not ordinarily engage each other and the tassels are weighted so that the ends of the control cord hang in a vertical and taut condition. The outer surface of the tassel is also a continuous surface that is preferably symmetric to discourage entanglement of the ends of the cord and thereby encourage the ends of the cord to hang independently of each other.

6 Claims, 9 Drawing Sheets

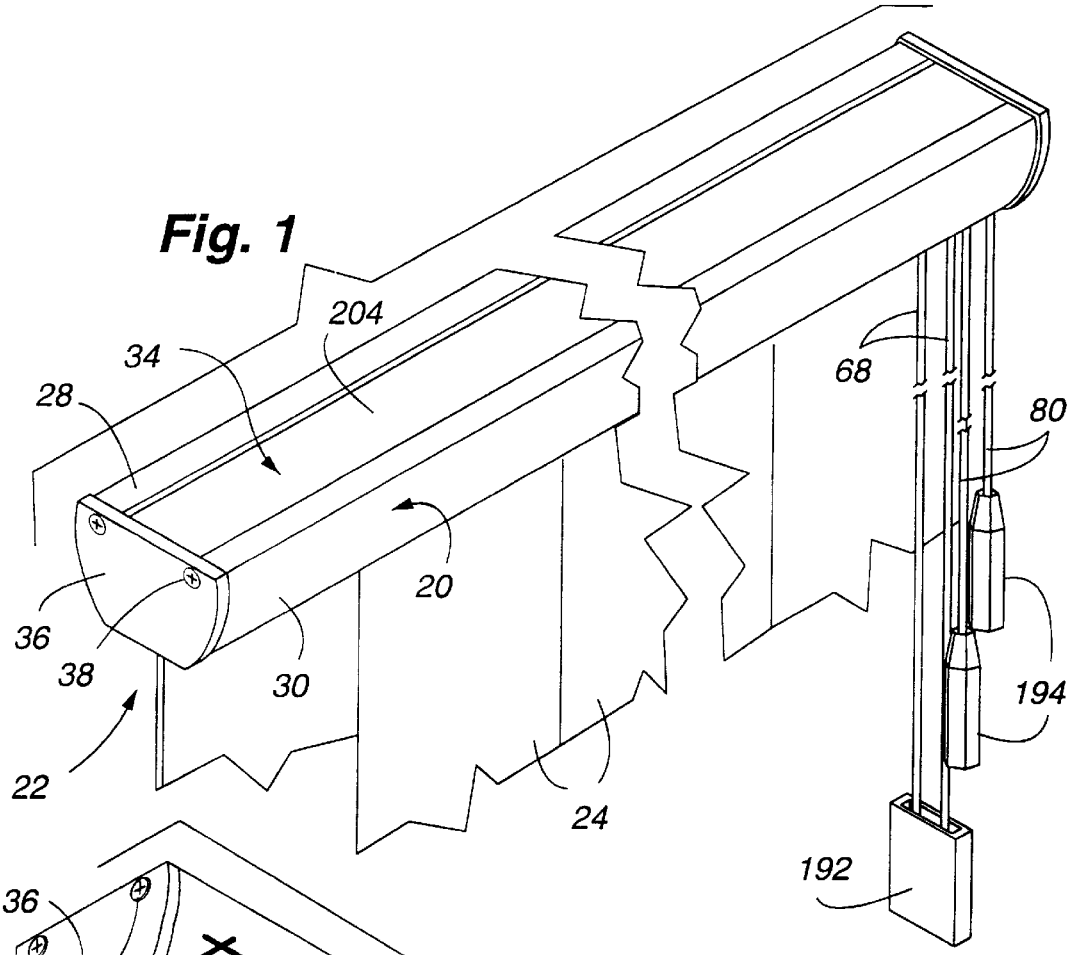
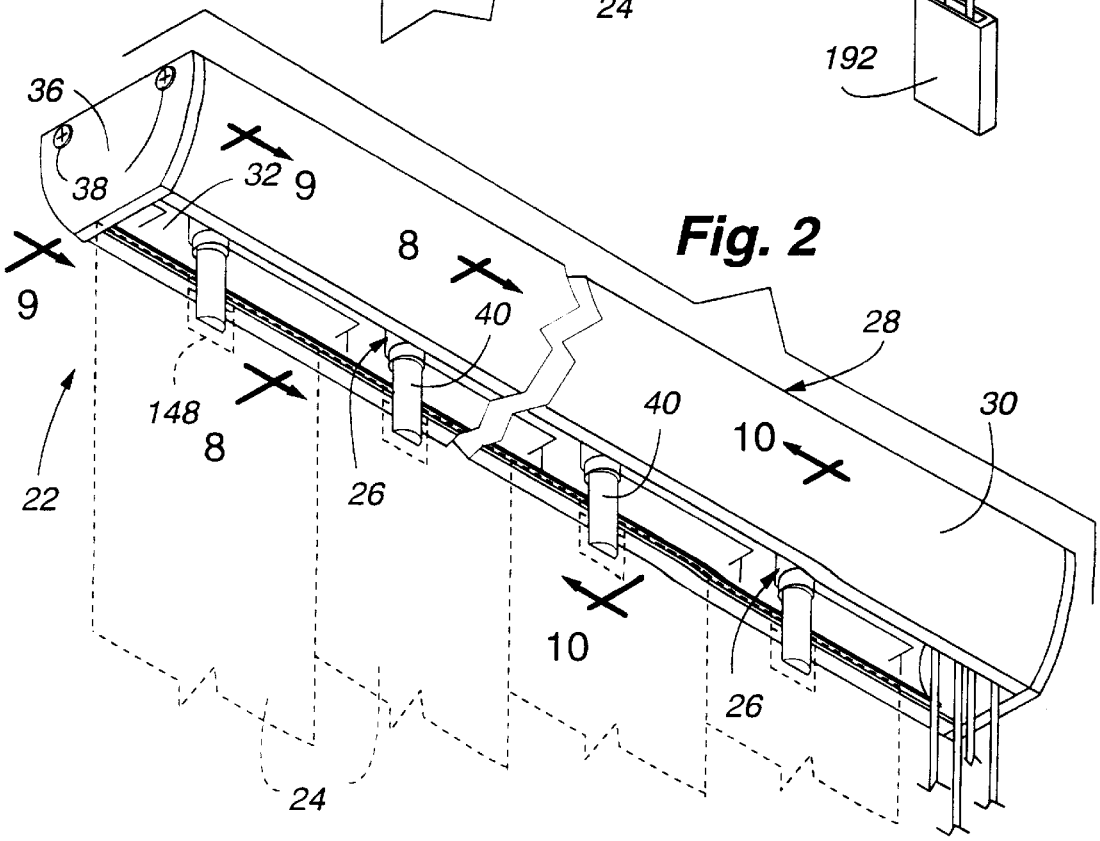
Fig. 2

Fig. 4
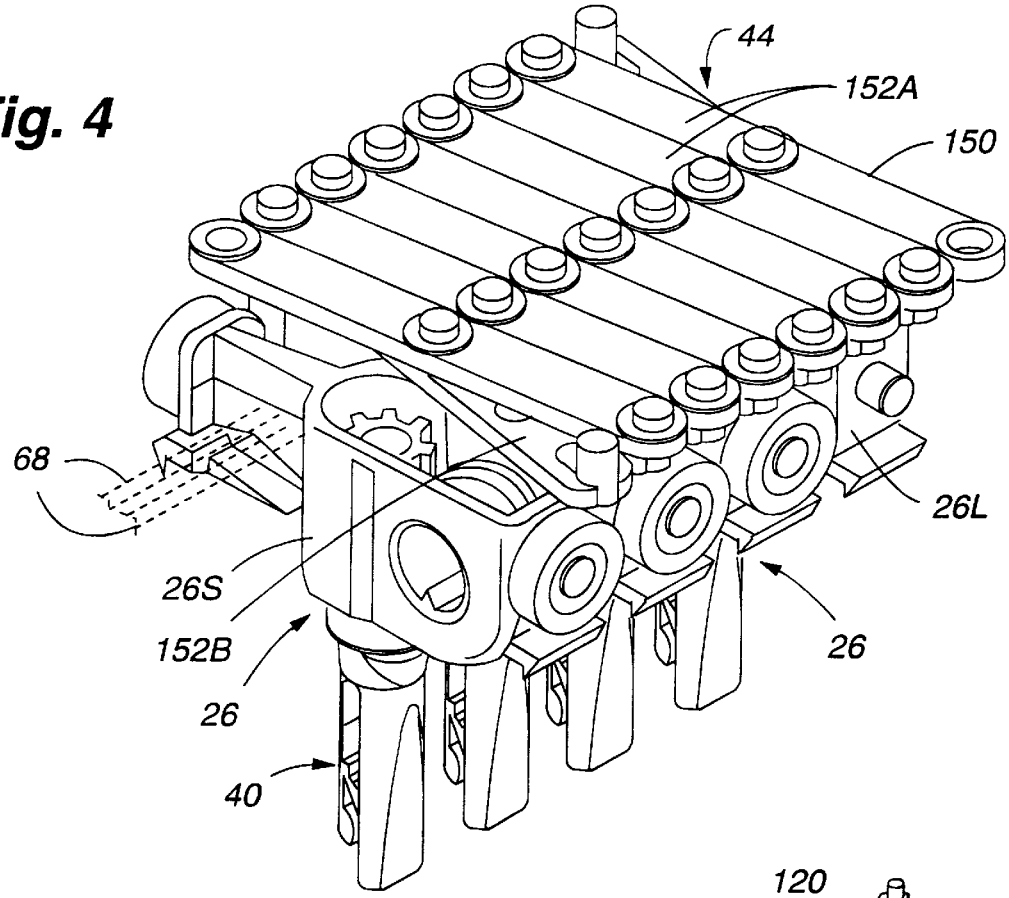
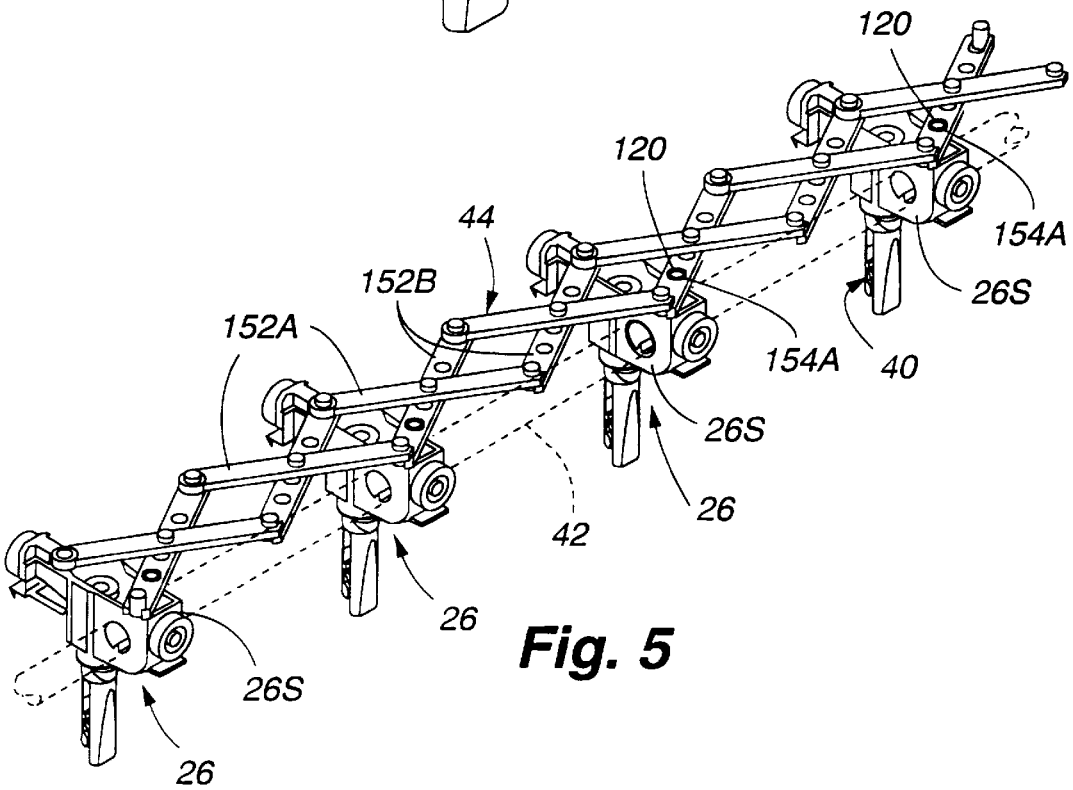
Fig. 5

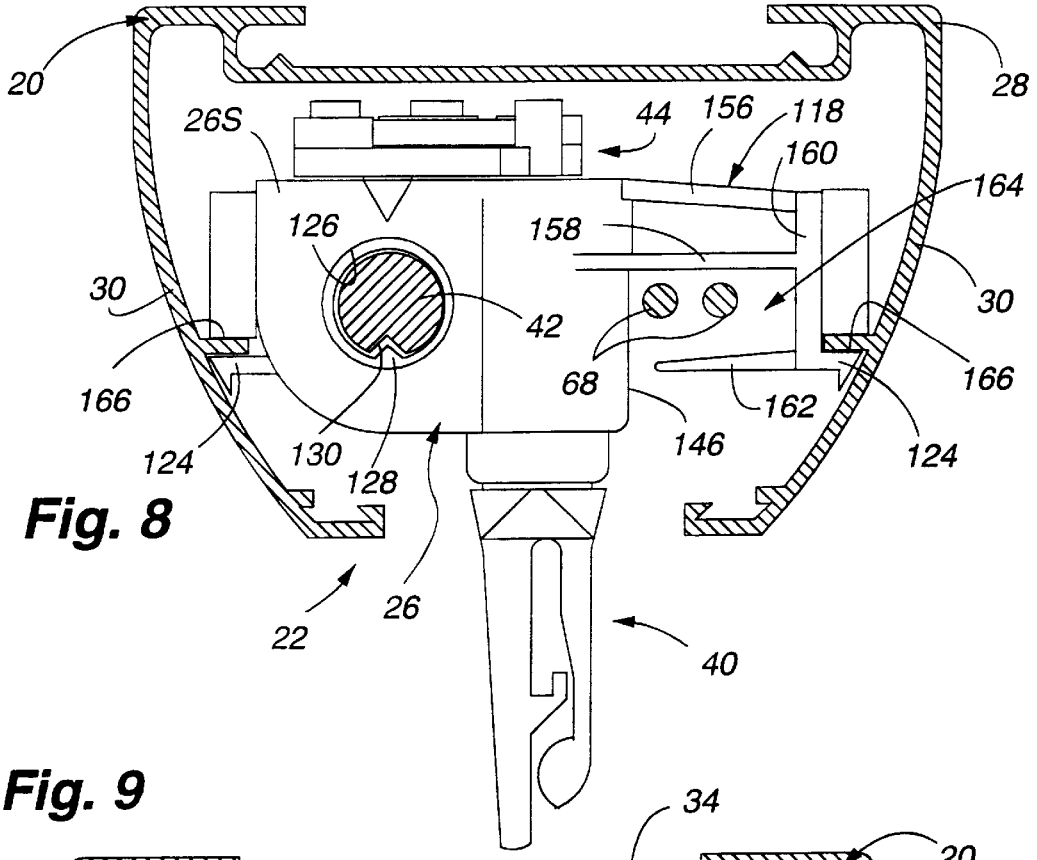
Fig. 8
Fig. 9
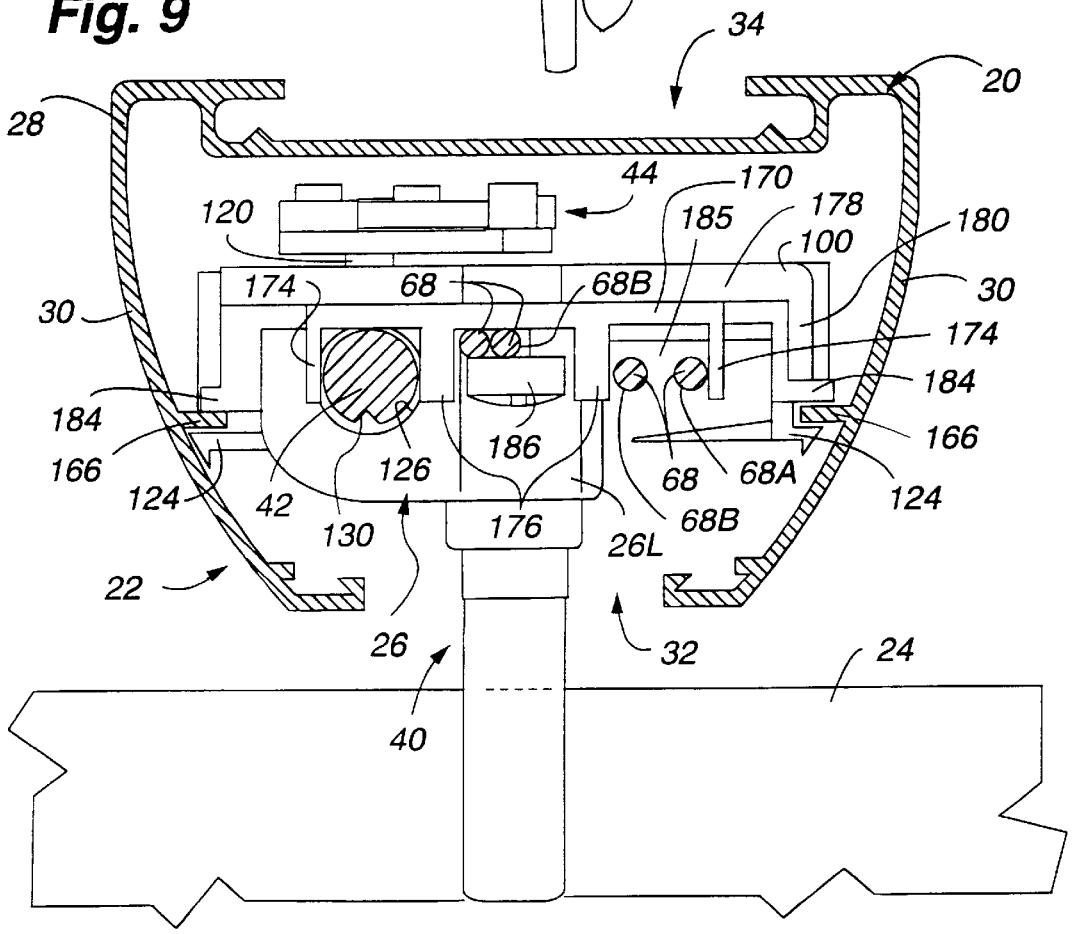

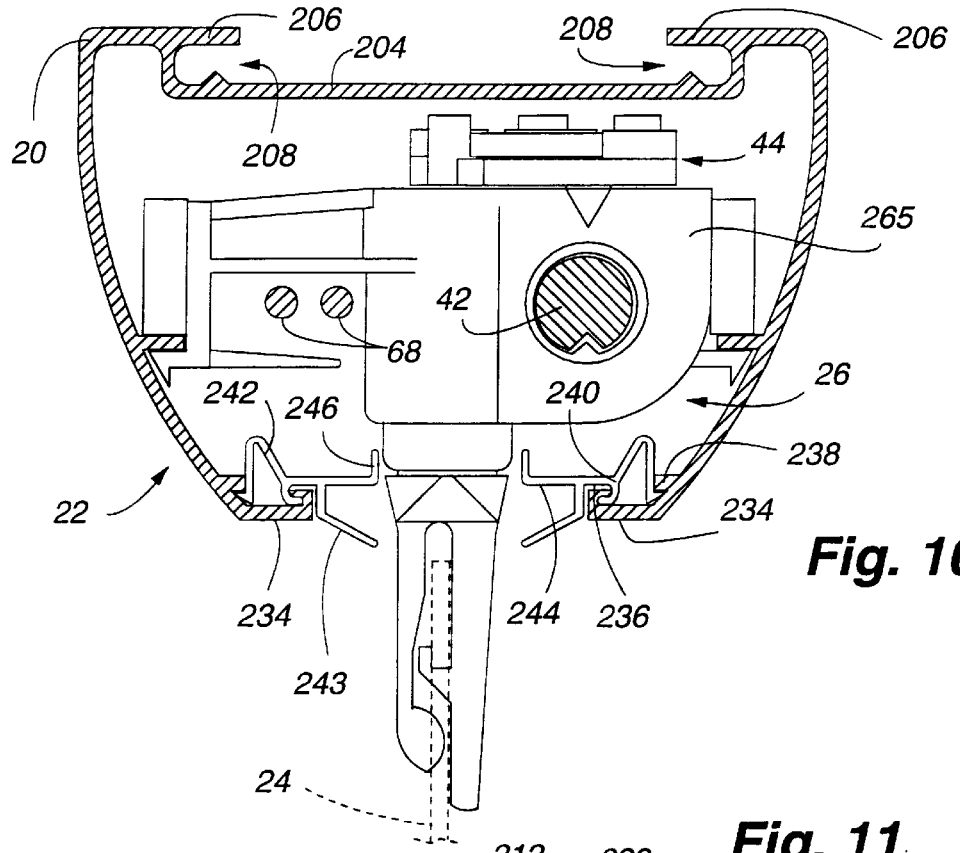
Fig. 10
Fig. 11
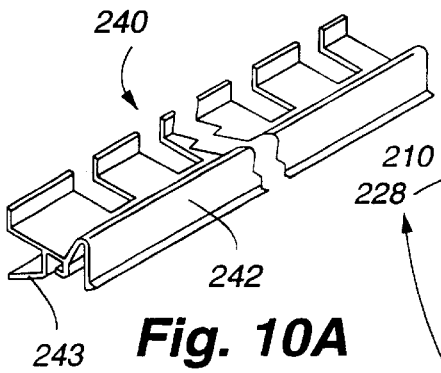
Fig. 10A
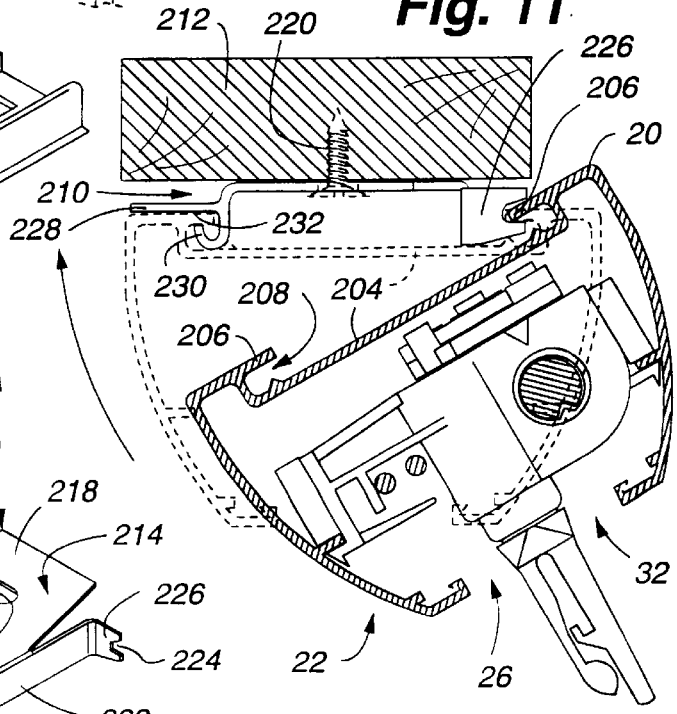
Fig. 12
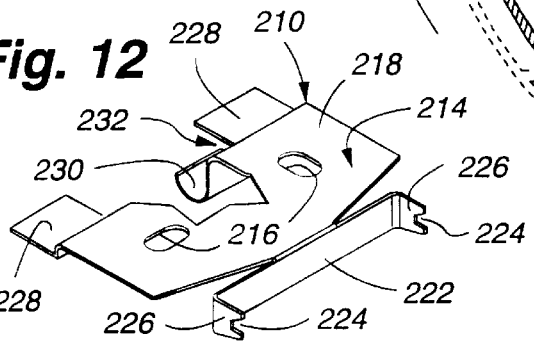

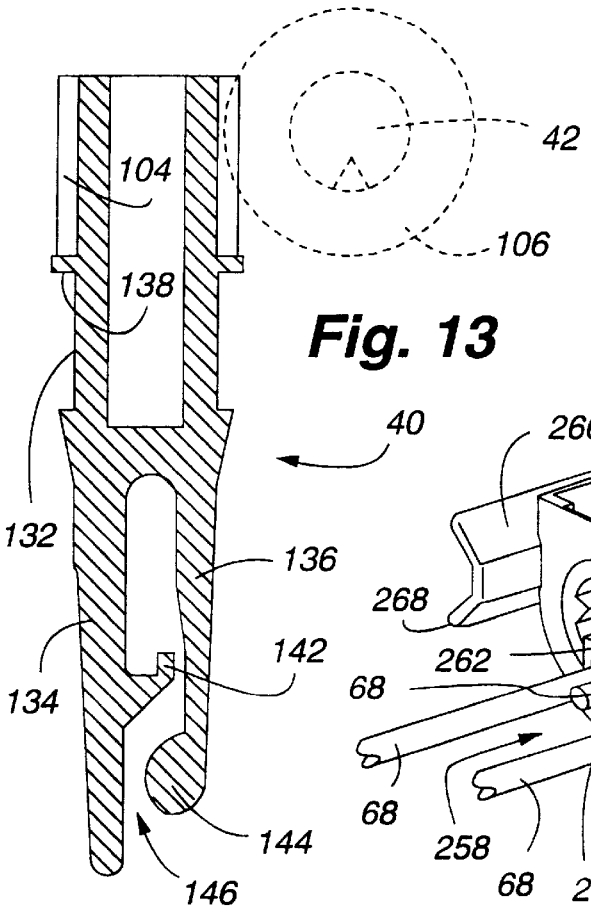
Fig. 13
Fig. 14
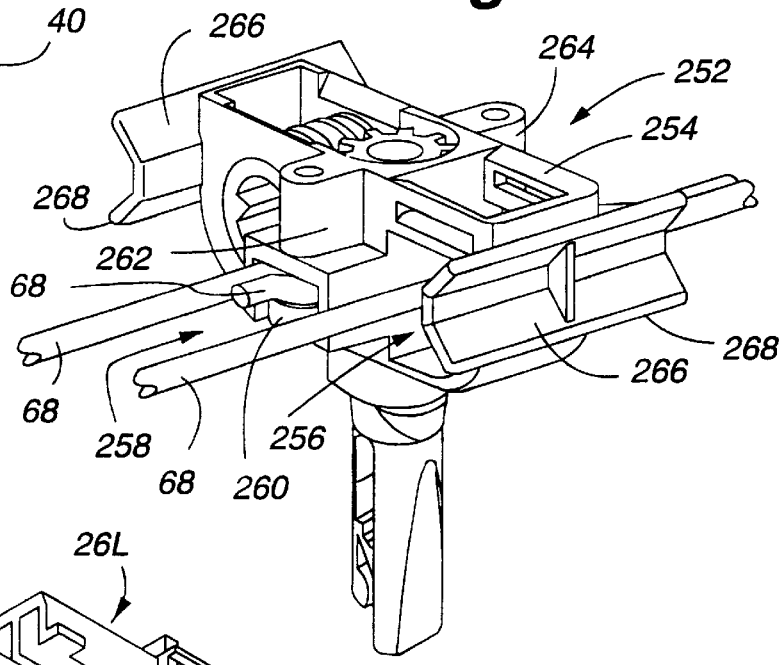
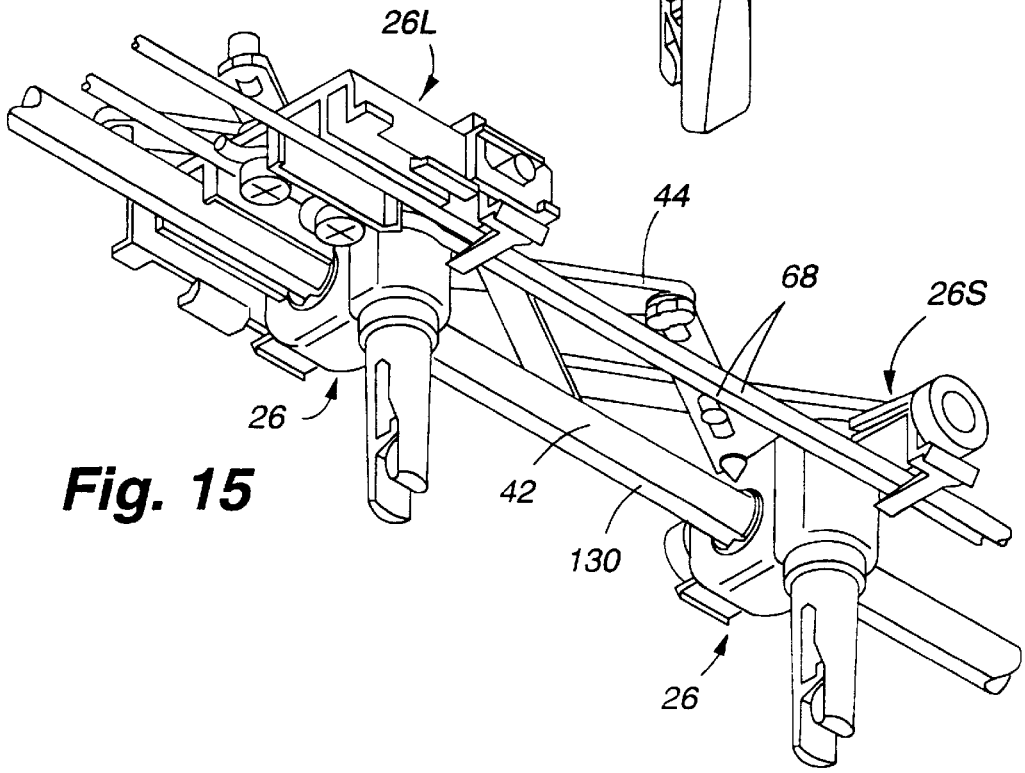
Fig. 15

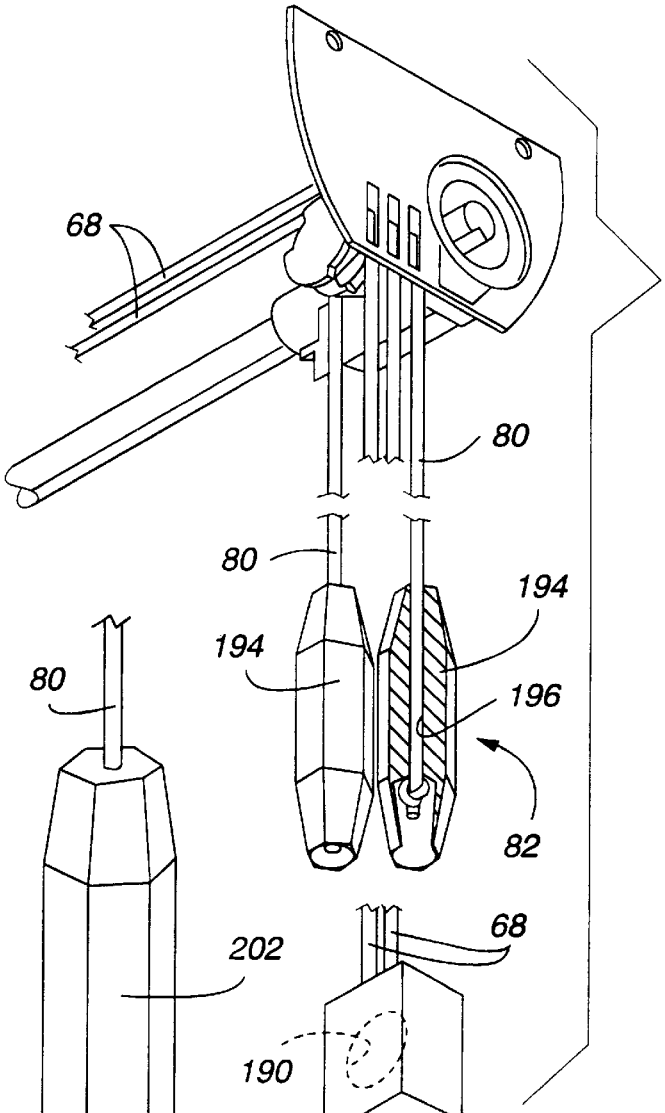
Fig. 16
Fig. 17
Fig. 20
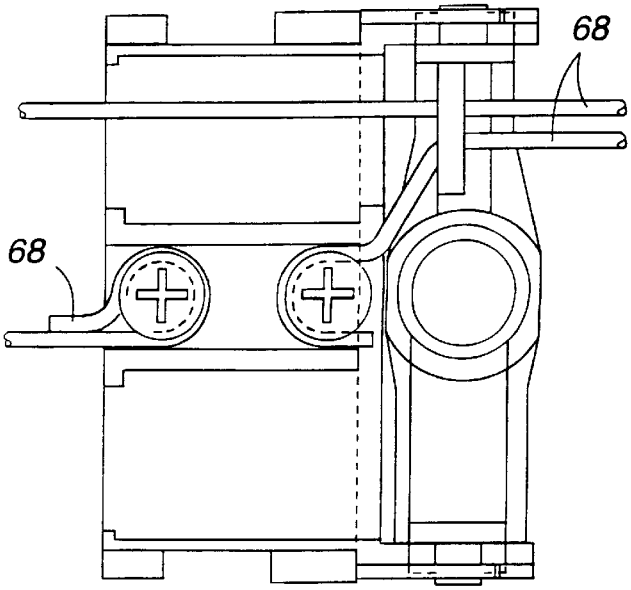

TASSEL FOR CONTROL SYSTEM FOR A VERTICAL VANE COVERING FOR ARCHITECTURAL OPENINGS

BACKGROUND OF THE INVENTION

1. Field of the Invention

The present invention relates generally to coverings for architectural openings such as doors, windows, and the like, and more particularly to a control system for a covering having a plurality of vertically suspended vanes linearly movable between extended and retracted positions, as well as pivotally movable between open and closed positions, to control visibility and the passage of light through the architectural opening.

2. Description of the Relevant Art

Covers for architectural openings such as doors, windows, and the like have been known in various forms for many years. One form of such covering is commonly referred to as a vertical vane covering wherein a control system suspends and is operable to selectively manipulate a plurality of vertically suspended vanes such that the vanes can be linearly moved laterally across the architectural opening to extend or retract the covering and can be pivoted about longitudinal vertical axes to open and close the vanes.

Control systems for operating vertical vane coverings typically include a headrail in which a plurality of carriers associated with each vane are mounted for lateral movement, and include internal mechanisms for pivoting the vanes about their vertical axes. The headrails vary in construction and configuration to house the various types of carriers, but typically the headrails are relatively large and rectangular in cross section to enclose the working components of the system. Many such headrails have a slot along a bottom wall through which a portion of each carrier protrudes for connection to an associated vane.

Most control systems include pull cords that are operably connected to the carriers to shift or linearly move the carriers horizontally along the headrail and across the architectural opening. Control systems also usually include a horizontally disposed tilt rod operably connected to each carrier such that rotational movement of the tilt rod about its longitudinal axis transfers corresponding movement to the carriers and subsequently to the vanes to effect pivotal movement of the vanes about their longitudinal vertical axes. The tilt rod is typically rotated by a pull cord or a tilt wand that can be grasped by an operator of the system.

Considerable attention has been given to the configuration and construction of headrails as they are readily visible in vertical vane coverings. U.S. Pat. No. 4,361,179 issued to Benthin, for example, discloses a headrail having an opening through the top thereof so as to improve the aesthetics of the headrail. The primary components of each carrier in the system are confined within the interior of the headrail and generally "C" shaped hangers associated with each carrier circumscribe the headrail so as to be in a position to support an associated vane from beneath the headrail.

Carriers in vertical vane coverings may be interconnected by a pantograph so that movement of an endmost or lead carrier causes all of the carriers to move correspondingly. One problem with prior art control systems has been the manner in which the carriers are connected to the pantograph. Typically, due to the central connection system and expansion of the pantograph upon movement of the lead carrier, the other carriers are caused to skew slightly resulting in increased friction and making them more difficult to move along the length of the tilt rod.

Another shortcoming in prior art systems which utilize pull cords to move the lead carrier is the fact that the pulleys for returning and deflecting the pull cords are normally relatively small in size thereby requiring multiple revolutions to allow significant movement of the carriers which increases system friction and imposes unnecessary wear on the system.

Another problem with prior art control systems resides in the fact that they are difficult to assemble inasmuch as the drive mechanism of the carriers associated with the vanes must be uniformly aligned and operably connected to the tilt rod so that pivotal movement of the tilt rod moves the vanes between associated and corresponding angular positions. Accordingly, if the carriers are not mounted on the tilt rod uniformly, the vanes will not be properly aligned and uniformly angularly related to the architectural opening. As will be appreciated, in order to properly align and uniformly angularly relate the vanes to the architectural opening, the carriers have to be carefully and uniformly mounted on the tilt rod, which can be a time consuming endeavor.

Still another prevailing problem with prior art control systems for vertical vane coverings resides in the fact that the vanes are suspended in spaced relationship from the bottom of the headrail thereby establishing a gap that allows undesired light to pass between the top edge of the vanes and the bottom of the headrail. While the window covering itself may adequately block the passage of light through the architectural opening, this spaced relationship of the top edge of the vanes with the headrail undesirably permits the passage of light through the gap.

Since the pull cords utilized to move the lead carrier along the length of a tilt rod apply a significant force to the lead carrier which, in turn, expands or contracts the pantograph to effect corresponding movement of the other carriers, it will be appreciated that a skewing of the lead carrier can also be a problem depending upon the spacing of the pull cords from the tilt rod on which the carriers are mounted. Skewing of the lead carrier which increases drag on the system has traditionally also been a problem in prior art systems.

As will be appreciated from the above, drag in a control system resulting from friction between the various relatively movable parts has been a drawback. Accordingly, a need exists in the art for a low friction system that is easy to operate and is more durable for extended maintenance-free operation.

Another shortcoming in many prior art systems relates to the design of the headrail. The design and configuration of the headrail, as may not be readily appreciated, can create problems for an installer of vertical vane coverings. Many headrails used in vertical vane coverings are non-symmetric in transverse cross section in order to accommodate in a compact manner the working components of the associated control system. Examples of such headrails are disclosed in U.S. Pat. No. 5,249,617 issued to During, U.S. Pat. No. 4,381,029 issued to Ford, et al., and U.S. Pat. No. 4,381,029 issued to Ford, et al. While such systems may compactly accept the associated components of the control system, they are many times undesirable from an installation standpoint as they can only be installed in one orientation. If a headrail is blemished or marred, for example, on an outer visible surface, it is usually deemed unusable.

It is to overcome the afore noted shortcomings in the prior art systems that the present invention has been developed.

SUMMARY OF THE INVENTION

The control system of the present invention is adapted for use in a covering for an architectural opening wherein the covering includes a plurality of vertically suspended vanes adapted to be uniformly disposed across the architectural opening or selectively retracted to one side of the opening. The control system is also adapted to selectively pivot the vanes about longitudinal vertical axes of the vanes so as to move the vanes between an open position wherein they extend perpendicularly to the architectural opening and in parallel relationship with each other, and a closed position wherein they lie parallel with the architectural opening and in substantially overlapping coplanar relationship with each other.

The control system has been uniquely designed for ease of assembly by an installer of the system and for ease of operation by a user. As in most vertical vane systems, the system of the present invention includes an elongated tilt rod that is confined within and supported by a headrail for rotative movement about its longitudinal axis. The tilt rod is operatively connected to a plurality of carriers disposed along its length, each of which suspends a separate vane, and wherein the carriers include a gear system driven by the tilt rod and adapted to selectively pivot the suspended vanes about their longitudinal axes. The tilt rod has a longitudinal groove adapted to cooperate with a mating projection on a gear within each carrier so as to facilitate uniform connection of the tilt rod with each carrier such that the vanes can be moved in unison between corresponding angles relative to the architectural opening for desired operation of the system.

The carriers are slidably mounted on the tilt rod for movement along the length of the tilt rod and are operably interconnected by a pantograph or scissors-type connector so that linear movement of any carrier along the tilt rod effects corresponding movement of the remaining carriers so that the vanes are, in turn, slidably moved across the window covering in unison. A pull cord system for selectively expanding or contracting the pantograph to correspondingly expand or retract the vanes across the architectural opening includes a traverse cord that is suspended along one side of the covering for operation, and is operably connected through a pulley system to a lead carrier for expansion and contraction of the pantograph and, thus, the covering. The lead carrier is a carrier at one end of the assemblage of carriers, and is the carrier that has full movement from one side of the architectural opening to the other as the covering is expanded or retracted by the traverse cord. The lead carrier, as well as the remaining standard carriers, has been uniquely designed so that the traverse cord is connected to the lead carrier in very close proximity to the tilt rod so as to minimize skewing of the lead carrier relative to the tilt rod upon pulling forces being applied to the lead carrier by the traverse cord. The traverse cord is preferably an elongated cord that is rendered endless by connection of the two ends of the cord to the lead carrier.

The tilt rod has been coated with a low friction material to further facilitate easy sliding movement of the carriers along the tilt rod.

Each standard carrier is uniquely designed to include a pocket or passage through which the traverse cord can freely extend. The pocket has a flexible side wall so that the cord can be inserted into the pocket by flexing the flexible side wall, but the flexible side wall is resilient and naturally returns to its original position to retain the cord within the pocket. This arrangement prevents drooping cords as has been a problem with conventional control systems.

Each carrier, with the exception of the lead carrier, has a pair of rollers adapted to ride on tracks provided internally along the length of the headrail so that the carriers move substantially friction free along the headrail.

Each carrier has a pair of engaged gears with one gear being a worm gear mounted on the tilt rod for unitary rotation therewith, and the second gear being a pinion gear associated with a hanger pin from which a vane is suspended. The carriers have been designed so that the pantograph interconnection with the carriers is centered over the tilt rod so as to minimize skewing of the carriers on the tilt rod upon expansion and contraction of the pantograph.

Each hanger pin has a pair of depending legs adapted to capture a vane therebetween. The vane is provided with an opening near its upper edge and one leg of the hanger pin has a hook that is removably received within the aperture so that the vane is suspended from one leg of the hanger pin. The hanger pin itself is uniquely designed so that the leg which bears the weight of the vane is relatively large in comparison to the other confining leg in contrast to conventional systems. The confining leg, which does not have a weight bearing function but merely captures the vane to prevent inadvertent release, is relatively thin and the overall weight of the pin has accordingly been reduced. The reduction in weight of the pin, however, has been obtained while obtaining an increase in strength by desirably distributing the weight of the pin onto the weight bearing leg.

The headrail for the control system has been uniquely designed so as to be transversely symmetric so that it can be installed in either direction without affecting the appearance or operation of the system. The headrail has a longitudinal slot along a bottom wall, and retention grooves along either side thereof to support and retain a light blocking rail, which extends downwardly from the headrail in close proximity to the top edge of the suspended vanes so as to substantially block the passage of light between the bottom of the headrail and the top of the vanes.

The pulleys used in the pull cord system have a diameter that is large relative to pulleys used in conventional systems, which not only improves the durability of the pulleys as they do not rotate through as many revolutions during operation of the covering, but in addition make the covering easier to operate, which is desirable from the user's standpoint.

Other aspects, features, and details of the present invention can be more completely understood by reference to the following detailed description of a preferred embodiment, taken in conjunction with the drawings, and from the appended claims.

BRIEF DESCRIPTION OF THE DRAWINGS

FIG. 1 is a fragmentary isometric view looking down on the control system of the present invention in use in connection with a covering for an architectural opening.

FIG. 2 is a fragmentary isometric similar to FIG. 1 looking upwardly at the control system.

FIG. 4 is an isometric looking down on elements of the control system without the headrail and illustrating the connection of the pantograph to a plurality of carriers, and with the pantograph in a retracted position.

FIG. 5 is an isometric looking down on the pantograph and interconnected carriers with the pantograph in an expanded position, and with the tilt rod shown in dashed lines.

FIG. 8 is an enlarged section taken along line 8—8 of FIG. 2.

FIG. 9 is an enlarged fragmentary section taken along line 9—9 of FIG. 2.

FIG. 10 is an enlarged section taken along line 10—10 of FIG. 2 with a suspended vane shown in dashed lines and illustrating light-blocking rails mounted on the headrail.

FIG. 10A is a fragmentary isometric view of one form of blocking profile that is attachable to the headrail to block the passage of light between the headrail and the suspended vanes.

FIG. 11 is an operational view similar to FIG. 10 showing the mounting of the headrail to a supporting beam.

FIG. 12 is an isometric view of a mounting bracket used to secure the headrail to a supporting beam.

FIG. 13 is a vertical section through a hanger pin showing the operatively engaged worm gear on the tilt rod shown in dashed lines.

FIG. 14 is an isometric view showing an alternative lead carrier for the system of the present invention.

FIG. 15 is a fragmentary isometric view of the lead carrier of the primary embodiment and a standard carrier mounted on the tilt rod and showing the pull cords and pantograph operatively connected therewith.

FIG. 16 is a fragmentary isometric view showing one end of the control system and weighted tassels for operating the control cords.

FIG. 17 is a fragmentary isometric view showing an alternative weighted tassel with the core separated from the outer shell.

FIG. 20 is a bottom plan view of the preferred embodiment of the lead carrier.

DESCRIPTION OF THE PREFERRED EMBODIMENTS

Figure 3:
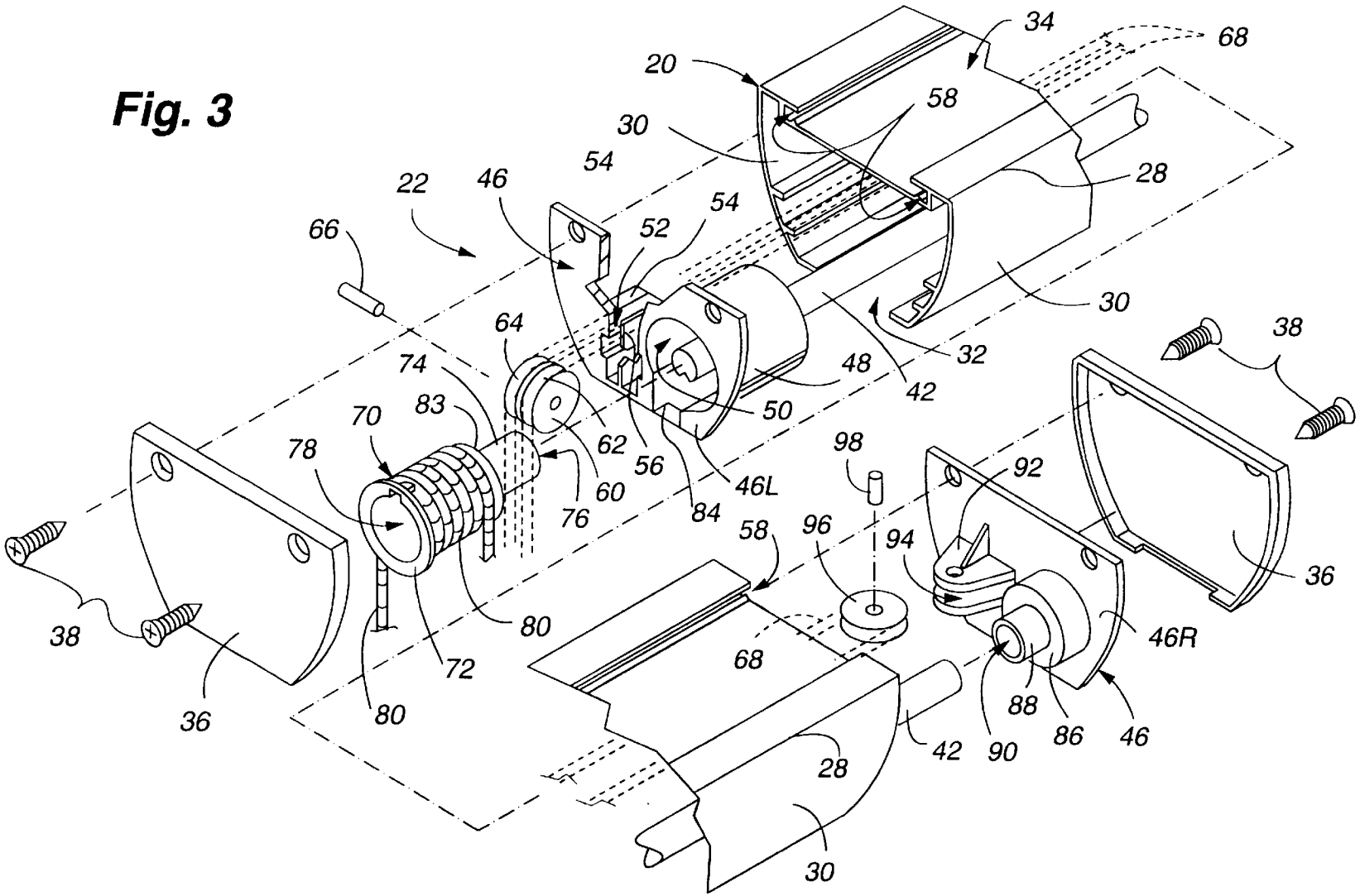
FIG. 3 is an exploded fragmentary isometric illustrating the internal operational components of the control system with the carriers having been eliminated.

The headrail 20 and other portions of the control system 22 of the present invention are shown in FIGS. 1 and 2 with vertical covering segments, hereafter referred to as vanes 24 but which might assume other configurations, being suspended from carriers 26 in the system in adjacent side by side relationship. For purposes of clarity, the vanes are shown in dashed lines in FIG. 2. The headrail for the control system is designed to extend completely across the top of an architectural opening (not shown), and be suspended in a manner to be described hereafter from a beam or other supporting structure at the top of the architectural opening. While not being illustrated, the control system 22 is adapted to move the vanes 24 from a retracted position wherein the vanes are horizontally stacked adjacent one side of the architectural opening to an extended position wherein the vanes are evenly distributed across the architectural opening. In the extended position the vanes are adapted to be pivoted about longitudinal vertical axes between open positions wherein they extend perpendicularly to the architectural opening and in parallel spaced relationship to a closed position as illustrated in FIGS. 1 and 2, with the vanes overlapping and being substantially coplanar with each other.

The headrail 20, as can be appreciated in FIGS. 1 and 2, is symmetric relative to a longitudinally extending vertical plane bisecting the headrail or, in other words, is symmetric in a transverse direction relative to the vertical plane. The headrail, as probably best seen in FIG. 3, has a main body 28 with arcuate downwardly convergent side walls 30 that are spaced at the top and bottom so as to define an open longitudinally extending slot 32 in the bottom and a longitudinally extending relatively broad groove 34 in the top. End caps 36 are securable with suitable fasteners 38 to each end of the main body for closure purposes.

The slot 32 in the bottom of the headrail 20 permits hanger pins 40, forming part of the carriers 26 to protrude downwardly from the headrail and thereby suspend in a manner to be described later associated vanes 24 at a spaced distance beneath the headrail. Control cords forming part of an operating system also depend through the open slot at one end of the headrail as will be appreciated from the description that follows.

Figure 6:
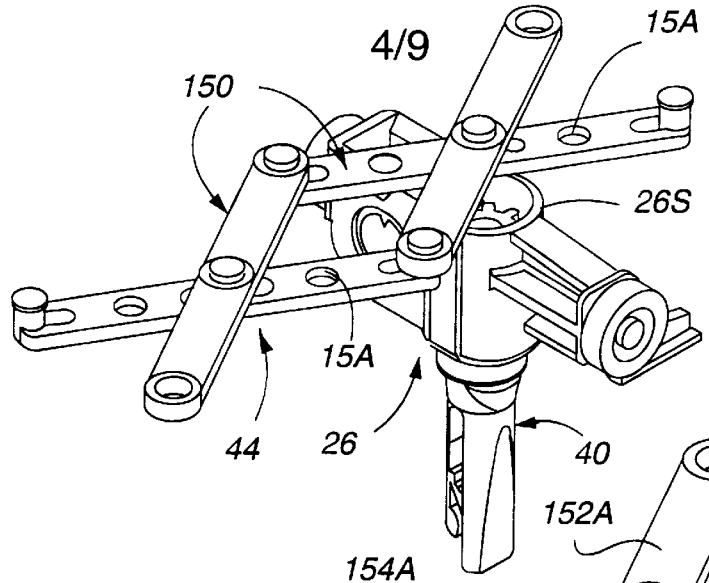
FIG. 6 is an isometric showing the connection of the pantograph with a single carrier.

In addition to the headrail 20, the control system 22 includes an elongated, horizontally extending tilt rod 42 (FIG. 3) with a cord operated system for rotating the tilt rod about its longitudinal axis, a plurality of the aforenoted carriers 26 which are slidably mounted on the tilt rod and operatively associated therewith for pivoting the vanes about longitudinal vertical axes, and a pantograph 44 interconnecting the carriers such that movement of a lead carrier 26L (FIG. 15) along the length of the tilt rod by a pull cord mechanism causes each of the standard carriers 26S to follow in desirably spaced relationship with each other. The pantograph, which forms part of an operating system with the pull cords and the tilt rod for manipulating the carriers, is probably best illustrated in FIGS. 6 and 7.

With reference to the exploded view in FIG. 3, the headrail 20 is illustrated with the end caps 36 having been removed from opposite ends thereof. Mounting plates 46 are securable to the end caps and are shown being properly positioned for supporting the operative components of the controls for pivoting the tilt rod 42 about its longitudinal axis, and for selectively expanding and retracting the pantograph 44. More specifically, at the left end of the headrail a mounting plate 46L is illustrated having a substantially cylindrically shaped bearing 48 with a cylindrical passage 50 therethrough. Adjacent to the cylindrical passage is a substantially "H" shaped slot 52 formed in a thickened section 54 of the mounting plate, with the slot 52 having a divider plate 56. The mounting plate 46 in cross section is identically shaped to the end cap, and is securable mounted thereto with the screw-type fasteners 38 that pass through openings in the mounting plate and are threadedly received in channels 58 formed in the main body of the headrail.

A dual pulley 60 with independently movable individual pulley segments 62 and 64 (as best seen in FIG. 3) is mounted in the H-shaped slot 52 in a vertical orientation and rotatably maintained in the slot by a pivot pin 66 that extends through the thickened section 54 on the mounting plate in which the H-shaped slot is formed to retain the dual pulley within the slot. The dual pulley, as will be described in more detail later, receives a traverse cord 68 used to move the carriers 26 along the length of the headrail.

The cylindrical passage 50 in the bearing 48 rotatably receives a barrel-shaped insert 70 (FIG. 3) having a large diameter portion 72 and a smaller diameter portion 74. The insert is hollow defining a relatively small diameter opening 76 through the smaller diameter portion 74 and a larger diameter opening 78 in the large diameter portion 72 of the insert. The smaller diameter opening 76 is adapted to slidably receive, but substantially conform in configuration and dimension with, one end of the tilt rod 42 so as to receive and support the end of the tilt rod for unitary rotation therewith. The large diameter portion 72 of the barrel insert defines a drum around which a tilt cord 80 extends. The tilt cord is wrapped around the drum to prevent slippage and so that the opposite ends of the cord 80 (FIG. 16), which depend from the drum, can be pulled to selectively rotate the drum about its longitudinal axis in either direction. The passage 50 through the cylindrical bearing 48 in the mounting plate 46L has large and small diameter portions to mate with the barrel insert so that the barrel insert is prevented from sliding through the bearing by a shoulder 83 (FIG. 3) on the barrel insert defined between the large and smaller diameter portions. The bearing on the mounting plate is slotted at 84 through the bottom so that both ends of the tilt cord 80 can hang therethrough.

The opposite or right end of the headrail, as best seen in FIG. 3, similarly has a mounting plate 46R with a cylindrical bearing 86 having a reduced diameter cylindrical protrusion 88. The bearing 86 defines a cylindrical passage 90 therethrough adapted to rotatably receive the opposite end of the tilt rod 42 which is predominantly rigid but slightly flexible. A gusseted bracket 92 also projects inwardly from the mounting plate and has a horizontal slot 94 therein adapted to rotatably support a horizontal pulley 96 that rotates about a pivot pin 98 received in the bracket. Again, the mounting plate 46R is secured to the associated end cap 36 with screw-type fasteners 38 that are inserted into and threadedly received in the channels 58 at the opposite end of the headrail. The horizontal pulley 96 receives the traverse cord 68 which is preferably an elongated cord that is effectively rendered endless by its connection to the lead carrier 26L in a manner to be described later. Both the horizontal pulley 96 and the dual pulley 60 are of relatively large diameter (i.e. approximately 0.608 inches) in comparison to pulleys used in most conventional systems which has been found to make the system easier to operate and extends the life of the component parts.

As mentioned previously, there are a plurality of carriers 26 disposed along the length of the headrail and slidably mounted on the tilt rod 42 for pivotal movement of the vanes 24 suspended from the carriers. The carriers are uniform in construction with the exception of the lead carrier 26L which is, in the preferred embodiment and as best seen in FIGS. 9, 15, 19 and 20, merely a modification of a standard carrier 26S through the addition of a snap-on carrier plate 100. The lead carrier will be described in more detail later.

Figure 7:
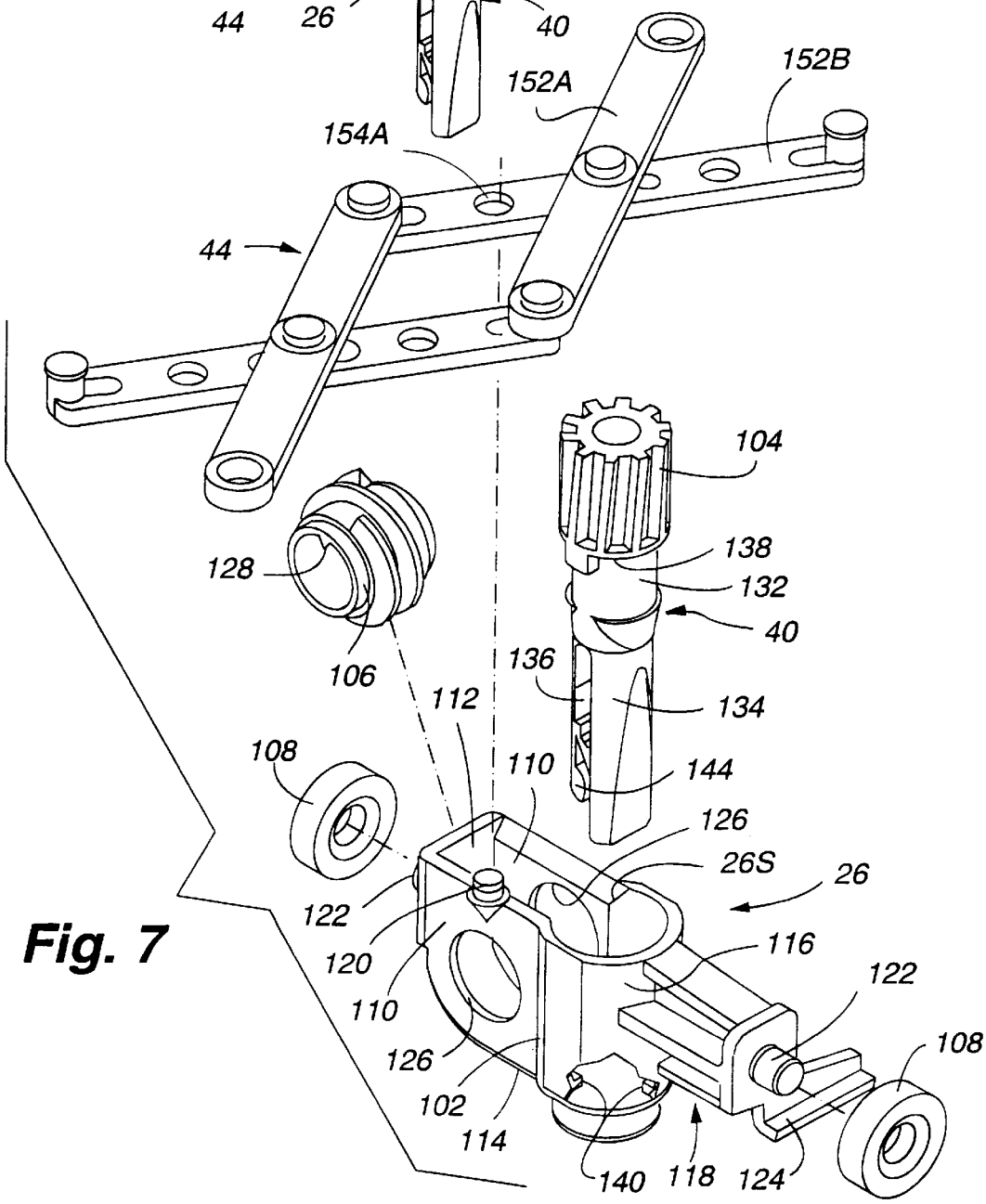
FIG. 7 is an enlarged exploded isometric view showing the connection of the pantograph with a single carrier.

Each carrier 26, probably best seen in FIG. 7, includes a main body 102, a hanger pin 40 having a pinion gear 104 on its uppermost end, a worm gear 106, and a pair of roller wheels 108. The main body is substantially hollow, having a pair of side walls 110, a flat end wall 112, a bottom wall 114, and an arcuate opposite end wall 116 from which a gusseted extension 118 forms a lateral extension. A connector in the form of a pivot pin 120 is formed on the top of one side wall 110 to enable attachment of the carrier to the pantograph 44. The gusseted bracket 118 and the flat end wall 112 each have stub shafts 122 formed thereon to rotatably receive an associated snap-on roller wheel 108. Mounted on the distal end of the gusseted bracket and on the flat end wall are horizontal slides in the form of substantially flat extension plates or ledges 124 (FIGS. 7 through 9) which cooperate with the associated roller wheels in guiding movement of the carrier along the headrail 20, as will also be explained hereafter.

Aligned circular openings 126 are provided through the side walls 110 in a vertical plane with the pivot pin 120, which are of a diameter substantially the same as the outside diameter of the tilt rod 42 so as to rotatably receive the tilt rod. The worm gear 106 is mounted on the tilt rod within the interior of the carrier and is keyed to the tilt rod with an inwardly directed generally V-shaped protrusion 128 (FIGS. 7 through 9) that is received in a longitudinally extending V-shaped groove 130 in the tilt rod. The worm gear, therefore, rotates in unison with the tilt rod.

The hanger pin 40, as best seen in FIGS. 7 and 13, is elongated and of generally cylindrical configuration defining the pinion gear 104 at its uppermost end, a central cylindrical body portion 132, and a pair of spaced depending legs 134 and 136 which are adapted to support the uppermost end of an associated vane 24. The hanger pin is pivotally mounted within the arcuate end wall 116 of the carrier body with a shoulder 138 at the lower end of the pinion gear being supported upon an inwardly directed rim (FIG. 7) projecting inwardly from the inner cylindrical wall of the arcuate section. The depending legs, therefore, protrude from the bottom of the main body.

Looking specifically at FIG. 13, one leg 134 of each hanger pin 40, which will be referred to herein as the supporting leg, has a hook shaped projection 142, and the body of the support leg is relatively thick in comparison to the other leg 136, which will be referred to as the confining leg. The confining leg 136 has a beaded lower end 144 so that a relatively thin channel 146 between the two legs opens downwardly to receive the uppermost edge of an associated vane 24 that has a transverse opening 148 (FIG. 2) therethrough adapted to be received upon and supported by the hook-shaped projection on the support leg. The confining leg urges the vane toward the support leg so that it does not inadvertently become released from the hanger pin. It is important to note that the confining leg, not having a supportive role, has been made relatively thin in comparison to the supporting leg thereby reducing the material used in the hanger pin. This reduction in material has been achieved while increasing the thickness of the supporting leg in comparison to conventional hanger pins so as to obtain approximately a 28% increase in strength while reducing the overall weight and cost of the pin. The average thickness of the supporting leg in the preferred embodiment is in the range of 0.095 to 0.105 inches, while the thickness of the upper end of the confining leg is in the range of 0.075 to 0.085.

When the hanger pin 40 is disposed within the main body, the pinion gear 104 is meshed with the worm gear 106 so that rotational movement of the worm gear about its horizontal axis effects pivotal movement of the hanger pin about its vertical axis. The tilt rod 42, which rotates the worm gear, thereby effects pivotal movement of the vane suspended from the hanger pin.

As mentioned previously, the pantograph 44 is a mechanism that operatively interconnects each carrier 26 so that movement of the lead carrier 26L causes a corresponding movement of the standard or following carriers 26S thereby uniformly distributing the vanes across the architectural opening or retracting the vanes adjacent to one side of the opening. The pantograph, as best seen in FIGS. 4 through 7, is generally conventional having a plurality of pivotally interconnected links 150 which are interconnected in a scissors-like manner. There are two sets of links 152A and 152B, with each set having a plurality of parallel links angularly related to the links of the other set. A link 152A of one set is pivotally connected at a midpoint to an associated link 152B of the other set, and the end of each link in a set is pivotally connected to the end of a link in the other set. One set of links 152B has a plurality of apertures 154 provided therethrough and one aperture 154A (FIG. 7) is offset from the center and substantially equally spaced or centered between the midpoint and one end of the link. The offset aperture is adapted to pivotally receive and be retained on the pivot pin 120 mounted on one side wall 110 of a carrier so that the link pivots about the pivot pin upon expansion or retraction of the pantograph. It is important to note and appreciate that the pivot pin 120 is vertically aligned with the tilt rod 42. In this manner, when the pantograph 44 is expanded or contracted causing the links to move longitudinally of the headrail 20, the force applied to the carrier 26 by the pantograph is along the tilt rod so that the carrier is not torqued or otherwise pulled in a manner that might cause the carrier to skew relative to the tilt rod. This connection causes a smooth gliding movement of the carriers along the tilt rod. To further improve the sliding movement, the tilt rod is preferably coated with a low friction material such as polyester so that there is a reduced resistance to movement of the carrier along the tilt rod.

As probably best seen in FIG. 8, the gusseted extension 118 on each standard carrier 26S is defined by an upper plate 156 and an intermediate plate 158 connected to the arcuate end wall 116 of the main body, as well as a vertical or distal end plate 160 interconnecting the distal ends of the upper and intermediate plates and protruding downwardly therefrom. The distal end plate 160 has one of the stub shafts 122 for the roller wheels 108 mounted on an outer face thereof and an inwardly projecting flexible horizontal finger 162 spaced downwardly from the intermediate plate 158. The flexible finger has a fixed end and a free end with the free end being spaced slightly, i.e. a distance slightly less than the diameter of the traverse cord 68, from the outer surface of the arcuate wall. It will be appreciated that a pocket or passage 164 is defined between the flexible finger 162, the intermediate plate 158, the outer surface of the arcuate end wall 116 and the distal end plate 160, which pocket is adapted to slidably receive and confine the traverse cord used in moving the carriers along the length of the headrail. The flexible finger is resilient so as to permit the cord to be inserted through the gap between the finger and the arcuate end wall, but the finger is rigid enough to retain the cord within the pocket after having been flexed so that if slack were to ever form in the cord, the cords would not droop from the pocket. In other words, the pocket confines the cord so that it will not distractive droop, for example, through the slot 32 formed in the headrail where it would otherwise be undesirably visible.

With further reference to FIG. 8, it will be appreciated that the arcuate side walls 30 of the headrail 20 have inwardly directed substantially horizontal protrusions or tracks 166 formed near the vertical center of the headrail. The tracks are adapted to support the roller wheels 108, at least one which might be slightly offset relative to the associated track, so that the carriers can roll along the length of the headrail when moved by the pantograph 44. The horizontal extension ledge 124 on the distal end plate 160 of each carrier 26 is spaced beneath the overlying roller wheel so as to accommodate an associated track on the headrail. The carrier is, therefore, confined on the tracks for movement there along by guide elements in the form of the roller wheels 108 and slides 124 which stabilize the carriers relative to the headrail. Either the carrier or the tracks can be coated with a low friction material to facilitate an easy sliding movement of the carriers with polyester being a suitable coating for this purpose.

Figure 19:
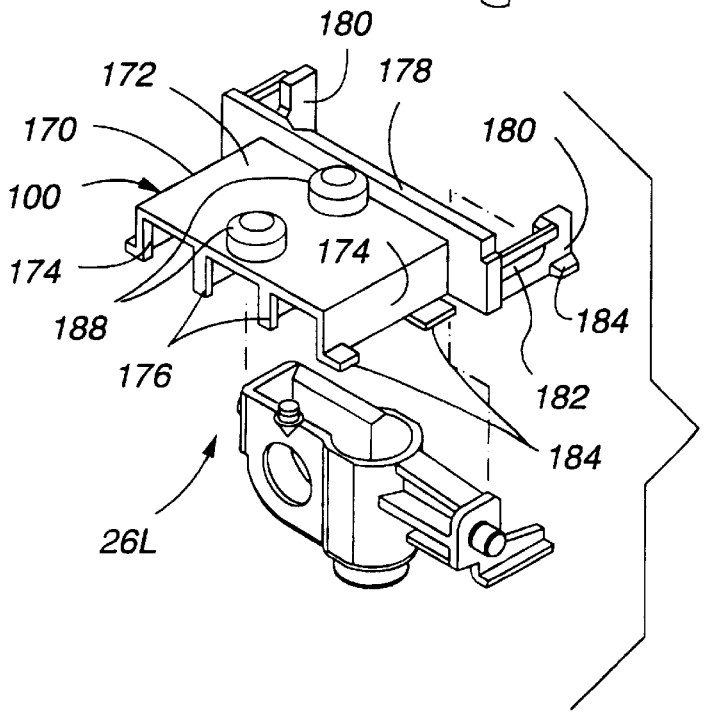
FIG. 19 is an exploded isometric of the lead carrier in the primary embodiment showing the component parts of the lead carrier.

In the primary embodiment of the present invention, the lead carrier 26L is merely a modified standard carrier 26S, as is probably best illustrated in FIGS. 9, 15 and 19. As is probably best seen in FIG. 19, the lead carrier 26L comprises a standard carrier 26S and the snap-on carrier plate or top bracket 100 which is releasable connected to the standard carrier. The top bracket 100 has a main body portion 170 defining a top plate 172, a pair of depending side plates 174, and a pair of depending intermediate plates 176, which extend in parallel with the length of the headrail 20. On one side of the main body portion, a generally U-shaped member 178 is formed which is slightly wider than the main body portion. On the horizontally extending legs 180 of the U-shaped member 178, elongated ovular horizontally oriented slots 182 are provided to releasable receive the stub shafts 122 on which the roller wheels 108 are mounted for the standard carrier 26S. In other words, on the lead carrier 26L, the roller wheels are either removed or not fitted and the stub shafts are snapped into the slots 182 on the horizontal legs of the bracket, which are resilient enough to allow the insertion of the stub shafts. Along the bottom edge of the legs 180 and the bottom edge of the side plates 174 are slides in the form of lateral, flat, plate-like protrusions 184 which are adapted to overlie the tracks 166 while the horizontal ledge 124 on the standard carrier body underlies the track of the headrail. In this manner, the lead carrier is confined for slid doing movement al long the tracks similarly to the standard carriers and, again, a coating of polyester or the like on the tracks provides a desirable low friction surface to facilitate an easy sliding movement.

As probably best illustrated in FIG. 9, the space between a side plate 174 and an intermediate plate 176 on the main body portion 170 of the top bracket 100 of the lead carrier 26L defines a downwardly opening channel 185 in which segments of the traverse cord 68 are aligned. The outermost segment 68A of the traverse cord passes through this channel 185, while the innermost segment 68B of the cord is diverted so as to extend between the two intermediate plates 176 where that particular cord segment 68B, which defines one end of the traverse cord, is secured to the lead carrier by a screw-type fastener 186 which is threaded from beneath into a boss 188 provided on the top plate. The outermost segment 68A of the cord which passes through the channel 185 extends to the far end of the headrail where it passes around the horizontal pulley 96 and returns with the opposite end of the traverse cord 68 being secured to the lead carrier 26L by the second one of two screws, FIG. 20, that is threaded from beneath into a second boss 188 on the top bracket. Accordingly, the traverse cord, which is an elongated cord, has two ends which are anchored to the lead carrier so that the cord forms or defines an endless loop secured to the lead carrier so that the lead carrier moves in unison with the cord. Of course, as mentioned previously, movement of the lead carrier causes a corresponding movement of the remaining standard, or follower, carriers 26S due to their interconnection with the pantograph 44.

The traverse cord loop extends at one end of the headrail around the horizontal pulley 96 and at the opposite end of the headrail, around the two halves of the vertical dual pulley 60, and from the dual pulley hangs downwardly and passes around a free or dangling vertically oriented pulley 190 (FIG. 16) within a weighted or spring-biased housing 192 (FIGS. 1 and 16), which retains the cord in a taut condition. As will be appreciated, when one of the depending portions of the traverse cord is pulled, the lead carrier 26L is caused to slide in a first longitudinal direction relative to the headrail 20, while pulling movement of the opposite portion of the cord causes sliding movement in the opposite direction. Movement in one direction of the lead carrier, of course, extends the vanes across the architectural opening, while movement in the opposite direction retracts the vanes adjacent to one side of the opening.

Tilting or pivotal movement of the vanes 24 about their vertical axes is effected through rotational movement of the tilt rod 42, as was mentioned previously, with this movement being caused by movement of the tilt cord 80, which is wrapped around the barrel insert 70 at the control end of the headrail. While not required, in the disclosed embodiment the tilt cord has two ends which are suspended adjacent to each other and support a weighted tassel 194 (FIGS. 1 and 16) so as to hold each cord in a vertical and taut condition. Pulling a tassel 194 at one end of the cord obviously pivots the tilt rod in one direction, while pulling the tassel at the opposite end of the cord rotates the tilt rod in the opposite direction. Through the intermeshing of the worm gear 106 and pinion gears 104 within each carrier 26, the vanes suspended from the carriers are caused to rotate in one direction or the other in unison and in alignment with each other.

While the weighted tassels 194 could take on numerous configurations, FIG. 16 shows a tassel being made of a relatively heavy material, such as zinc or Zomac alloy, having a longitudinal hole 196 therethrough which receives one end of the tilt cord 80 which can be knotted to prevent the tassel from slipping from the cord. In an alternative embodiment shown in FIG. 17, an interior core 198 of a relatively heavy material such as zinc, having an axial passage 200 therethrough to receive the tilt cord 80 can be utilized with the cord being knotted at one end to prevent release of the core and an outer shell 202 of possibly a more aesthetically attractive material being slidably received over the core.

As is best appreciated in FIG. 16, the cross-sectional size or horizontal dimension of the tassels in relation to the spacing between the cords to which they are attached is such that the tassels are suspended in horizontally spaced relationship from each other. In other words, when the weighted tassel is suspended vertically from its associated end of the tilt cord 80, even if the tassels are suspended at the same elevation, they will remain in a disengaged or spaced relationship from each other. Further, it is important to note that the tassels have a continuous outer surface which in the disclosed embodiment is symmetric and hexagonal in transverse configuration. In the disclosed embodiment, the size of the hexagonal cross-section varies along the length of the tassel but the outer surface has the same cross-sectional configuration, albeit of a different size, along its length. By weighting the tassels as described above and dimensioning the tassels relative to the spacing between the ends of the cords such that the tassels do not engage in their normally suspended condition and, further, through the assistance of a continuous outer surface on the tassel, the tassels are encouraged to remain separated and independent from each other and will not easily become tangled or remain tangled if they are inadvertently wrapped around each other. In other words, even if the ends of the cord are wrapped around each other, the weighted tassel pulls down on the associated end of the cord and the continuous surface of the tassel allows the cords to become untangled until they rest in a spaced relationship from each other, as shown in FIG. 16.

As will be appreciated, the entanglement of tilt cords effectively forms a closed loop. Closed loops have presented problems inasmuch as children's body parts are easily caught in the closed loop causing injury to the child. Accordingly, the weighted tassels of the present invention with their continuous outer walls in predetermined cross-sectioned size and spacing provide an improvement over prior art tassel systems.

As mentioned previously, the headrail 20 is provided with a broad groove 34 along its upper surface, with the groove formed by a depressed plate portion 204 (FIGS. 1 and 11) vertically spaced from overhanging ledges 206 on the top of the headrail. The space between the ledges 206 and the depressed plate portion 204 define pockets 208 adapted to cooperate with a mounting plate 210 (FIGS. 11 and 12), which is securable to a beam 212 or other structural member above an architectural opening. The mounting plate, as best seen in FIGS. 11 and 12, has a flat plate-like main body 214 with openings 216 through a top plate 218 thereof adapted to receive screw-type fasteners 220 to secure the plate to the supporting beam. The plate has a generally U-shaped connector 222 on one side with notches 224 on the free ends of legs 226 of the connector and plate-like horizontal extensions 228 extending in the opposite direction. The horizontal extensions 228 overlie and are spaced from a hook-shaped projection 230 from the bottom of the top plate. The horizontal extensions are spaced above the hook-shaped projection 230 so as to define a pocket 232 adapted to receive one of the overhanging ledges 206 of the headrail, while the other overhanging ledge 206 is received in the notches 224 in the free ends of the legs 226 on the U-shaped connector. When connecting the headrail to the mounting plate, one overhanging ledge 206 is inserted into the notches on the U-shaped connector and the headrail is then pivoted, as shown in FIG. 11, until the overhanging ledges are horizontally aligned, with the second horizontal ledge being snapped into the pocket 232 between the hook-shaped projection 230 and the horizontal extensions 228. The headrail can be removed from the mounting plate in a reverse procedure, with it being understood that the hook-shaped projection is flexible enough to be moved out of blocking alignment with the overhanging ledge.

The lower surface of the headrail 20, as best seen in FIG. 10, defines two parallel ledges 234. The innermost extent of each ledge has an inverted hook-shaped protrusion 236 which confronts an inwardly directed protrusion 238 from the associated arcuate side wall 30. The two protrusions define a pocket therebetween. Each pocket is adapted to receive a portion of a light-blocking rail or gap-restricting profile 240, which extends longitudinally of the headrail. The light blocking rail, as best seen in FIG. 10A, has an inverted V-shaped channel 242 formed along one side, with laterally directed edges adapted to extend beneath the protrusions 236 and 238 on the headrail. The edges thereby support the light-blocking rail and incorporate it into the headrail so that an angled flange 243 which extends downwardly through the longitudinal slot 32 in the headrail at an acute angle to horizontal from the associated ledge 234 on the bottom plate substantially fills the gap between the bottom of the headrail and the top of the suspended vanes. The flange 243 thereby forms a light-blocking barrier to light which might pass beneath the headrail 20 but above the top edge of the vanes 24. The angle of the light-blocking flange prevents damage to the vanes in the event they swing about their connection to the hanger pins, such as in air currents passing through the architectural opening, as the vanes would then engage the light blocking rail at a non-damaging angle.

The depending angled flange 243 is interconnected with a horizontal leg 244 of each light-blocking rail, which in turn has an upturned lip 246 on its innermost end. The horizontal interned leg 244 need not be continuous along the length of the light-blocking bar so as to save material costs and to increase flexibility. The horizontal leg 244 functions as a tilt rod support which prevents the tilt rod from sagging beneath the headrail when the carriers are drawn to one side. When the carriers are distributed along the length of the tilt rod, they too assist in supporting the tilt rod through their support on the tracks 166.

Figure 18:
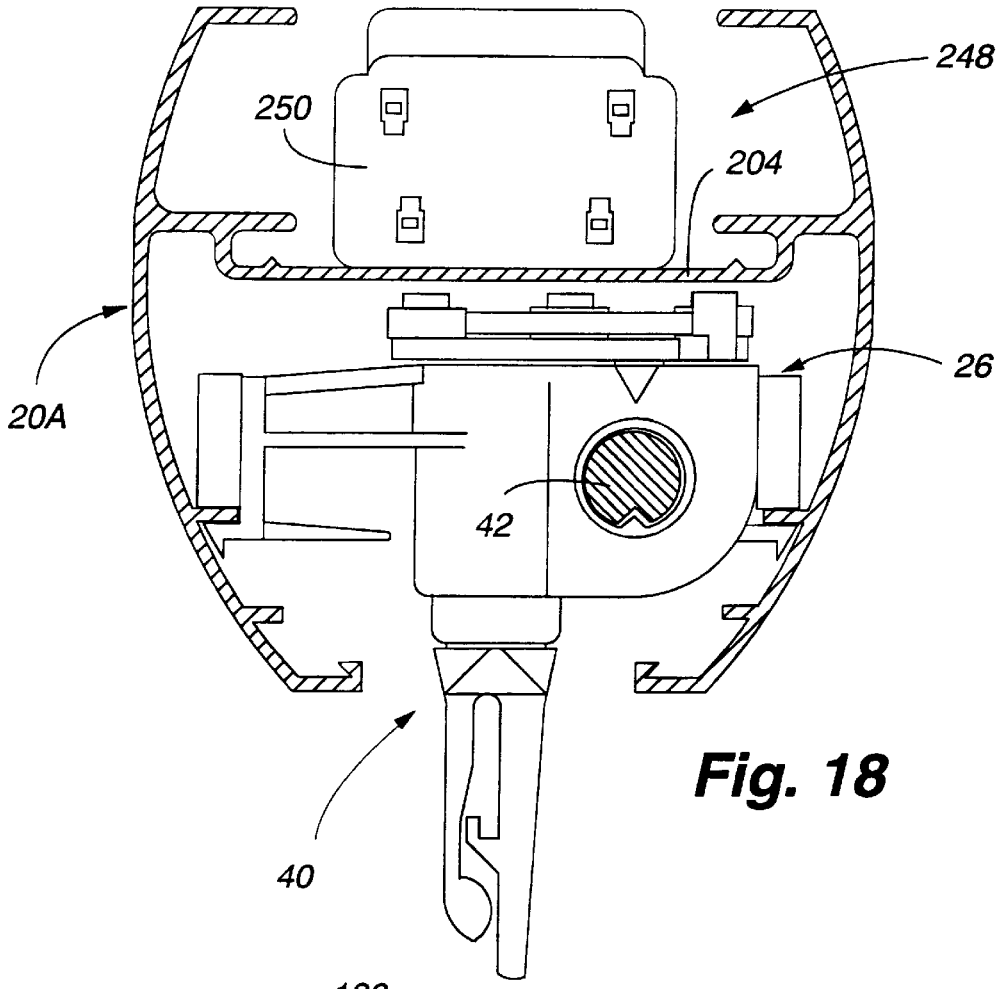
FIG. 18 is a diagrammatic section taken through a modified embodiment of the operating system of the present invention showing a standard carrier and an electric motor operatively connectable to the tilt rod to selectively pivot the carriers.

In an alternative embodiment of the invention, as shown schematically in FIG. 18, the headrail 20A is enlarged vertically so as to define a pocket 248 above the depressed plate portion 204 in which an electric motor or motors 250 can be mounted and used to operate the traverse cord and/or tilt rod for automated operation of the control system. The manner in which the motor or motors would be connected to the tilt rod or to the cords would be within the skill of one in the art and, therefore, has not been described in detail.

As was mentioned previously, the lead carrier 26L in the preferred embodiment is simply a standard carrier 26S having been modified with the inclusion of a top bracket or carrier plate 100. An alternative lead carrier 252 is shown in FIG. 14. The lead carrier 252 is a single unit comprised of a hollow main body 254 which pivotally supports a hanger pin 40 with a pinion gear 104 that is meshed with a worm gear 106 through which the tilt rod 42 extends and is keyed for unitary rotative movement. These portions of the lead carrier are the same as described in connection with lead carrier 26L. The main body includes a channel 256 through which both segments of the traverse cord 68 enter and only the outer segment 68A passes through for further extension around the horizontal pulley 96 at the end of the headrail. The inner segment 68B of the traverse cord is secured in a central downwardly opening channel 258 of the lead carrier by a set screw 260 threaded into a boss 262 formed on the carrier main body, while the returning outer segment 68A of the traverse cord enters the same downwardly opening channel 258 from the opposite direction, and is also secured in the channel by a set screw (not seen) that is threaded into a second boss 264 provided on the main body of the carrier. The main carrier body has two outwardly opening, horizontally disposed V-shaped brackets 266 having lower edges 268 that are adapted to slide along the tracks 166 of the headrail. The V-shaped brackets are elongated so as to cooperate with the elongated side walls 30 of the headrail in keeping the carriers from skewing relative to the tilt rod as the carrier is moved along the length of the headrail by the pantograph. Accordingly, the elongated V-shaped channels add still another system for assuring alignment of the carriers to facilitate free sliding movement for ease of operation of the system.

It will be appreciated from the above that a control system for a vertical vane covering for an architectural opening has been described which has a number of advantages over prior art systems. Due to the alignment of the connection of the pantograph 44 with each carrier 26 over the tilt rod 42, skewing of the carriers is minimized. Similarly, the formation of pockets in each carrier to receive the traverse cords and position the cords closely adjacent to the tilt rod also minimizes skewing so that the carriers are enabled to move easily along the headrail and the tilt rod. A low friction coating of the tilt rod further enhances the easy sliding movement.

The longitudinal groove 130 in the tilt rod, which cooperates with the protrusion on the worm gear 106 in each carrier, facilitates an easy assembly of the system in that the relative positioning of the worm gear 106 and pinion gear 104 can be made on each carrier so that the vanes associated with each carrier are positioned uniformly angularly. With this uniform relationship, an insertion of the tilt rod through the worm gears in each carrier allows the vanes to be very easily mounted and angularly aligned upon assembly.

The light blocking rails 240 are also easily connected to the headrail 20 and positioned in an aesthetically attractive position to not only substantially block the passage of light between the headrail on the top edge of the vanes 24 but in a manner such that the vanes are not damaged should they swing about their connection to the hanger pins.

The relatively large pulleys 60 and 96 used on the traverse cord enable an easy operation of the system while minimizing wear and heat generation to extend the life of the system. Further, the headrail 20 itself is symmetric about a longitudinal vertical central plane so that it can be mounted in either direction. This not only makes the system easy to mount, but also facilitates hiding a marred or blemished side wall of a headrail thereby salvaging headrails that might not be usable in other systems.

Although the present invention has been described with a certain degree of particularity, it is understood that the present disclosure has been made by way of example, and changes in detail or structure may be made without departing from the spirit from the invention, as defined in the appended claims.

What is claimed is:

1. A pull-cord system for selectively positioning a covering for an architectural opening, said pull-cord system comprising an operating cord having first and second ends, wherein said ends of said operating cord are suspended adjacent to each other and at a predetermined horizontal spacing from each other;

a first tassel attached to said first end of said operating cord; and a second tassel attached to said second end of said operating cord, wherein each of said tassels comprises a body having a horizontal width dimension that is less than said predetermined horizontal spacing between said first and second ends of said operating cord, said first and second tassels having a weight that is sufficiently heavy to retain said first and second ends of said operating cord in a substantially vertical orientation so that said tassels remain disengaged even when disposed at the same elevation.

2. The pull-cord system of claim 1 wherein said body of said first and second tassels further includes a continuous outer surface.

3. The pull-cord system of claim 2 wherein the horizontal cross-section of said first and second tassels is symmetric.

4. The pull-cord system of claim 3 wherein the horizontal cross-section of said first and second tassels is hexagonal.

5. The pull-cord system of claim 3 wherein the horizontal width of said first and second tassels varies along their vertical dimension.

6. The pull-cord system of claim 1 wherein said first and second tassels include zinc or zomac alloy.

* * * * *